US005560608A

United States Patent [19]

Silverschotz

[11] Patent Number: 5,560,608

[45] Date of Patent: Oct. 1, 1996

[54] SCRATCH-OFF GAME CARD INCLUDING INK FOR MAKING MARKINGS THEREON AND METHOD OF MAKING THE SAME

[75] Inventor: Stanford B. Silverschotz, Livingston, N.J.

[73] Assignee: Webcraft Technologies, Inc., Horsham, Pa.

[21] Appl. No.: 454,942

[22] Filed: May 31, 1995

[51] Int. Cl.[6] ..... A63F 3/06

[52] U.S. Cl. ..... 273/240; 273/269; 273/139

[58] Field of Search ..... 273/269, 139, 273/240

[56] References Cited

U.S. PATENT DOCUMENTS

| | | | |
|---|---|---|---|
| Re. 34,673 | 7/1994 | Desbiens | 273/269 |
| 4,212,468 | 7/1980 | Knott | 273/240 |
| 4,354,845 | 10/1982 | Poteet et al. | 273/240 |
| 4,877,253 | 10/1989 | Arens | 273/240 |
| 5,074,566 | 12/1991 | Desbiens | 273/269 |
| 5,193,815 | 3/1993 | Pollard | 273/269 |

FOREIGN PATENT DOCUMENTS

| | | | |
|---|---|---|---|
| 621061 | 10/1994 | European Pat. Off. | 273/269 |

*Primary Examiner*—Benjamin H. Layno
*Attorney, Agent, or Firm*—Shlesinger Arkwright & Garvey

[57] ABSTRACT

A scratch-off game card includes first and second sections. The first section is provided with a first set of game data covered by a substantially opaque scratch-off material. The second section is provided with a second set of game data covered by a substantially transparent material. The game card has provided thereon a patch of marking formulation for marking selected areas of the second section.

22 Claims, 3 Drawing Sheets

SCRATCH-OFF GAME CARD INCLUDING INK FOR MAKING MARKINGS THEREON AND METHOD OF MAKING THE SAME

FIELD OF THE INVENTION

This invention relates to the structure of a game card of the instant scratch-off type, and particularly but not exclusively to a Bingo game contained within the game card.

BACKGROUND OF THE INVENTION

The popularity of instant scratch-off games has grown over recent years, fostered by commercial retail interests and particularly by governmental entities as a means of raising revenue. However, sales of instant scratch-off lotteries tend to fall as the public tires of similar themes. Accordingly, lottery operators attempt to introduce new concepts while utilizing the scratch-off medium. One such concept is the adaptation of the conventional Bingo game to a scratch-off game card. In this concept, the game card is divided into a "caller" area on which random Bingo numbers are covered with an opaque scratch-off material, and a "Bingo-card" area on which visible randomly printed numbers appear under the B, I, N, G, and 0 column headings. In this concept, the player reveals the randomly printed "called" numbers by removing the opaque scratch-off compound with a coin or similar common object and compares these with the randomly printed visible numbers shown on the "Bingo Card" areas. If the player finds that five matching numbers or "Free" space form a straight line horizontally, vertically, or diagonally, as in a conventional Bingo game, or other winning patterns as declared by the particular game rules, then that game card is recognized as a winning card entitling the player to a prize in accordance with the established prize structure of the game.

This concept requires a feature in the physical structure of the game card that is not required in prior instant scratch-off lottery game cards. This new feature is one that permits the player to mark matching numbers on the Bingo card area in a convenient way that will make a five-in-a-line or other winning condition readily evident. This feature is not only necessary to assist the player in identifying a winning pattern, but the lottery agency also requires a rapid method for identifying and confirming a winning pattern presented for redemption.

One prior art means for marking cards is described by Pollard in U.S. Pat. No. 5,193,815. In this technique the Bingo card numbers are covered with a transparent or translucent scratch-off material that contains a transparent dye or pigment of a primary color, such as yellow, which appears green when covering an underlying lightly screened tint of blue. When the yellow dyed scratch-off material is removed as a covering from a printed number, the color in that area appears to change from green to blue thus indicating a match between a "called" number and that "Bingo Card" number. While effective in indicating a matched number, this method does not allow for the possibility that a player may inadvertently scratch off a non-matched number in the Bingo card area because the method of marking is not reversible or erasable by the player.

Another prior art technique for indicating a match between "called" numbers and "Bingo-Card" numbers in described by Desbines in U.S. Pat. No. 5,074,566, in which the "Bingo Card" portion numbers are first printed over a printed screen of a color or shade different from that of scratch-off material, and then covered with an opaque scratch-off material. The scratch-off material is then printed over with an identical set of numbers. When the match is seen, the player removes the uppermost number along with the scratch-off underlying that number, revealing an identical number beneath. This method, in addition to having the shortcoming of not being erasable or reversible, entails the additional manufacturing cost of an additional digitally controlled variable printing unit of an in-line web printing system in order to print the overlying numbers, and the additional controls required to prevent the potential error of misregister between underlying and overprinted numbers in the variable printing process.

Still another prior art technique for indicating a match between the called numbers and numbers appearing in the Bingo card portion of the ticket involves the use of microencapsulated dyes, the microcapsules are in turn covered by a transparent or translucent film. The player may fracture or crush the microcapsules through the film with a coin edge and release the dye of a contrasting color from inside the capsule walls. This method also suffers from non-reversibility as well as the added cost of microencapsulation and the special equipment needed to avoid breaking microcapsules during application to the game ticket in the manufacturing process. This technique further poses the inherent problem associated with the use of microcapsules. In particular, if the microcapsules are overprotected to prevent accidental rupture during handling, then it is difficult for the user to cause their rupture. If, on the other hand, microcapsules are insufficiently or minimally protected, then frequent unintended rupturing of microcapsules during handling of the cards occurs. This techniques is therefore undesirable as it presents many drawbacks.

Still yet another technique involves the use of a translucent coating over the Bingo card portion of a ticket. This coating allows a player to see the underlying numbers and when rubbed with a coin or similar marking device, produces discoloration or smudge which is different from the color or hue of the unrubbed portion. The discoloration can be used to indicate a match with the "called" numbers.

None of the above-described techniques, however, emulate the traditional method commonly used by players of actual Bingo games in various fund raising activities in churches, schools and other institutions. The traditional method involves the use of a felt marking device saturated with washable ink to mark the matching numbers on Bingo cards.

In view of the only non-traditional methods of marking Bingo cards that are presently available, there is a need in the industry for a technique that closely resembles with the traditional method.

OBJECTS AND SUMMARY OF THE INVENTION

It is the main object of this invention to provide a game card with the capability for conveniently marking matches between visible numbers or other indicia, with uncovered previously hidden numbers or the called numbers in an actual Bingo game, by a technique that emulates the traditionally used technique for marking a card in a Bingo game.

It is another object of this invention to provide a game card with ink or other marking formulation provided as a dried patch in a separate area on the surface of the game card. The marking formulation is non-toxic and can be easily remoistened by the user and applied as a color tint to the matching numbers on the Bingo card portion of the card.

It is another object of the invention to provide a game card in which the marking ink or the like formulation can be applied as a coating by conventional flexographic, gravure, serigraphic, or lithographic printing techniques.

It is yet another object of the invention to provide a game card which has a tear-off section that can be used as a brush to remoisten the marking formulation and then used to mark the "called" numbers on the card.

In summary, the main object of the present invention is to provide a game card which has thereon a patch of dried marking ink or formulation which can be remoistened by a player to mark the intended portions of the game card.

DETAILED DESCRIPTION OF THE INVENTION

Figure 1:
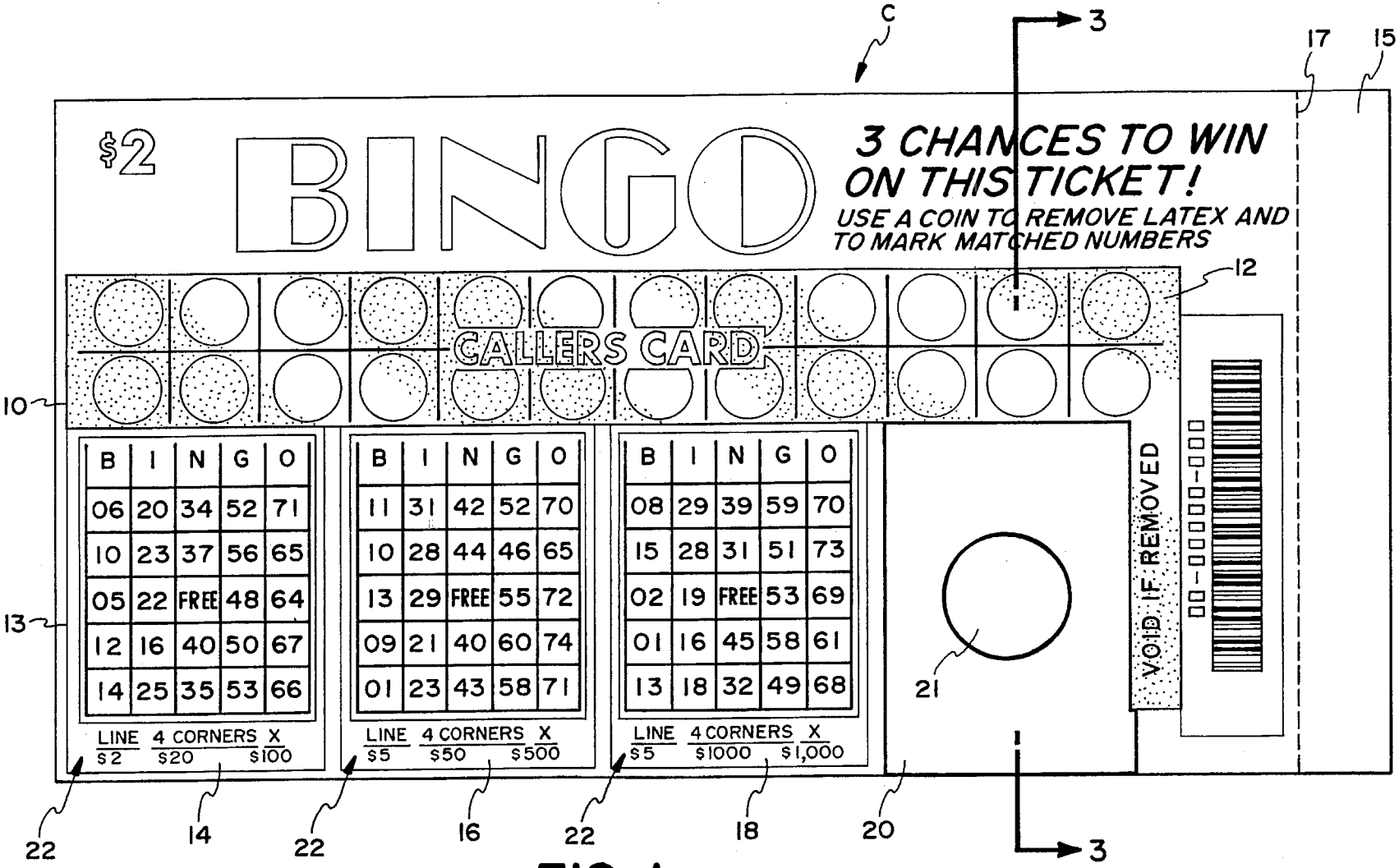
FIG. 1 is a plan view of a game card made in accordance with the present invention showing the Bingo game with the various areas of covered and visible variable printing.

Referring to FIG. 1, a game card C in the form of a Bingo game is shown with a "callers" area 10 containing randomly drawn Bingo numbers which are concealed beneath a scratch-off latex material 12, while a series of three Bingo "cards" 14, 16 and 18 are visible in the player area 13, and each is provided with numbers 22 displayed in the columns below the letters B, I, N, G, and O. The card C is preferably made in accordance with the structure disclosed in co-pending application Ser. No. 08/183,389, filed Jan. 19, 1994, the disclosure of which is incorporated herein by reference.

Figure 2:
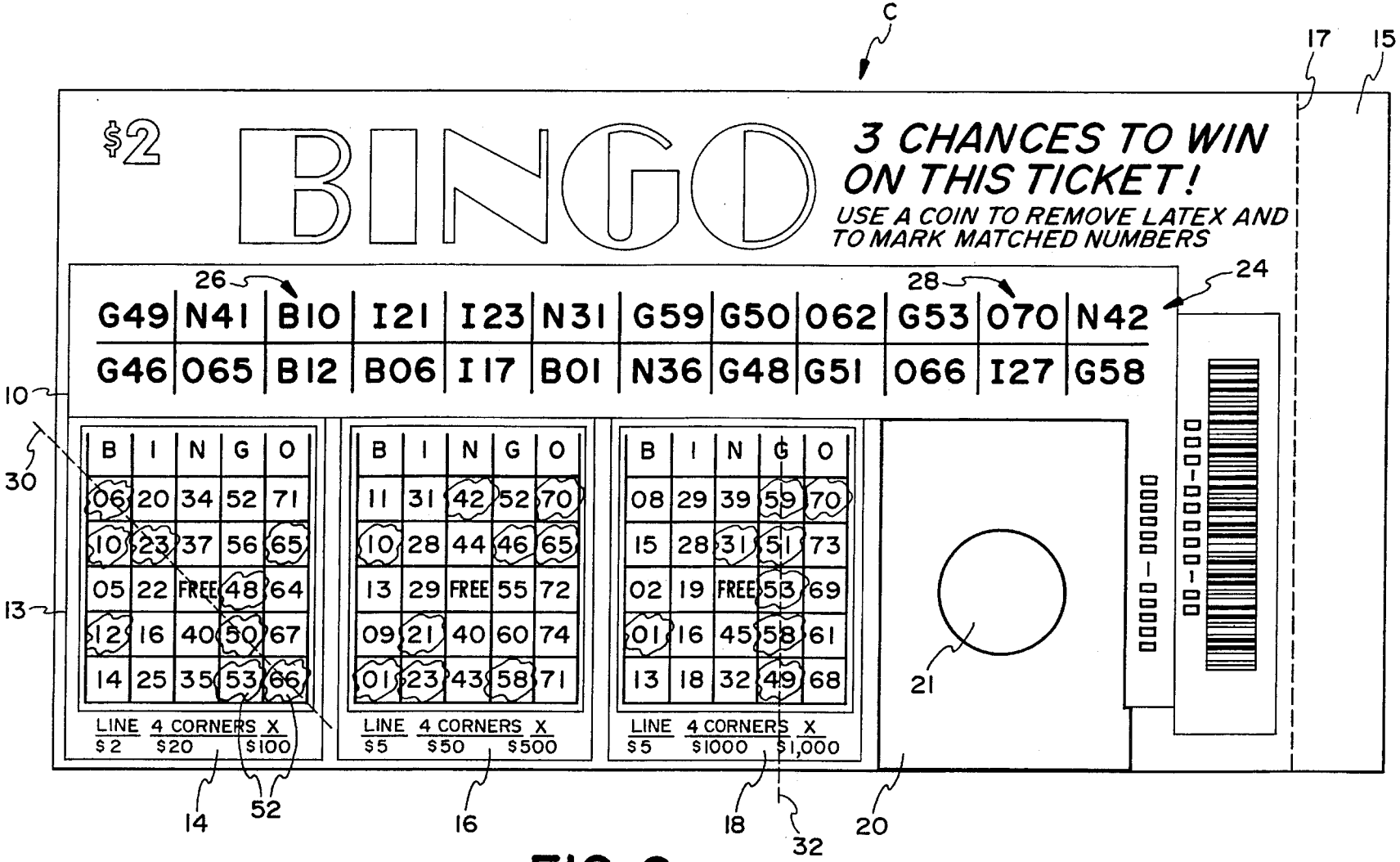
FIG. 2 is a plan view of a game card identical to that in FIG. 1, except that the scratch-off material has been removed from the "Callers Card" area and the matched Bingo numbers are marked in accordance with the technique of this invention.

Referring to FIG. 2, the latex scratch-off material 12 is shown removed revealing the "called" numbers 24. In the example shown, called number B-10, designated by numeral 26, appears in the callers area 10 and also appears on the second Bingo card area 16 in the column headed by B. The player is required to examine each Bingo card area 14, 16 and 18, and compare the "called" numbers 24 with those in each Bingo card area to determine if a winning pattern, as defined by the game rules, exists. Since it is extremely difficult to remember all of the number matches and the patterns formed, provision is made for the player to mark the matched numbers by using formulation in patch 21, as in the case of called number 070, which appears in the called area 28, and in the second and third Bingo cards 16 and 18. In the case shown in FIG. 2, winning patterns are discerned in the first Bingo card 14 as a diagonal line 30, and on the third Bingo card 18 as a vertical line 32 in the G column.

In the area 20 of game card C, an ink or marking formulation in the form of patch 21 is applied and dried in accordance with conventional techniques. Preferably, the marking formulation is a water-soluble colored coating, such as PAAS (registered trademark of Plough, Inc.).

Figure 3:
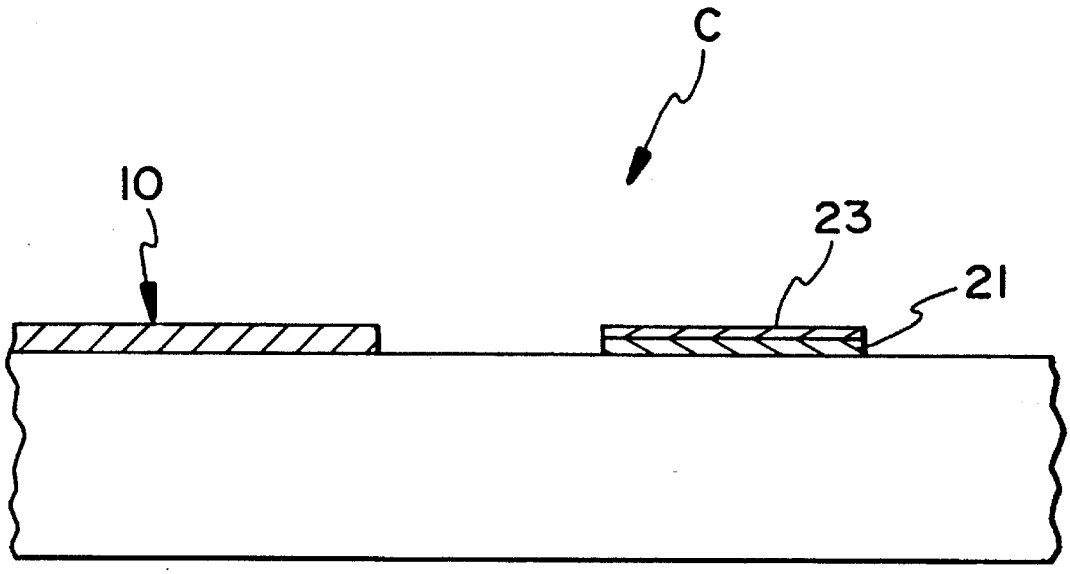
FIG. 3 is a fragmentary, schematic cross-sectional view of a preferred embodiment of the game card of the invention taken along line 3—3 of FIG. 1.

In order to avoid inadvertent wetting (by sweat saturating a pocket of a shirt, for example) a thin layer of clear scratch-off or peelable FIG. 3 applied as a liquid may be used to cover to PAAS or similar water color until it is to be used.

Recognizing that the users would likely use saliva and finger tip to remoisten the water color, the water color must be composed of food grade colors and binder materials, as is the case for PAAS.

The surface of the player portion 13 of the card C is preferably covered with a transparent material which is "receptive" to the water color. The coin rub composition and the surface characteristics of a card made in accordance with the technique described in application Ser. No. 08/183,389, has such property Accordingly, with this concept we can offer the dual marking approach of color coating and coin rub.

As best shown in FIGS. 1 and 2, a tear-off section 15 is provided. The section 15 is preferably made of the same material as the card C and is in the form of a narrow strip. Depending upon the card printing and size requirements, the strip 15 may alternatively be provided on a different edge of card C than as shown in FIGS. 1 and 2. In use, the strip 15 is severed along tear-line perforation 17 and one of its ends can be used as a conventional brush to remoisten patch 21 and mark the numbers in the player area 13.

While this invention has been described as having a preferred design, it is understood that it is capable of further modifications, uses and/or adaptations of the invention following in general the principle of the invention and including such departures from the present disclosure as come within the known or customary practice in the art to which to invention pertains and as may be applied to the central features hereinbefore set forth, and fall within the scope of the invention and of the limits of the appended claims.

What is claimed is:

1. A game card, comprising:

a) a substrate including first and second sections, said first section located on a first area of said substrate, and said second section located on a second area of said substrate separate from said first area;

b) said first section including a first set of game data;

c) said second section including means for marking selected areas of said first section; and d) said marking means including a marking formulation.

2. The game card of claim 1, wherein:

a) said marking formulation comprises a solvent based coating.

3. The game card of claim 1, wherein:

a) said marking formulation is non-toxic to humans.

4. The game card of claim 1, wherein:

a) said marking formulation is covered by a removable layer.

5. The game card of claim 1, wherein:

a) said first set of game data is covered by a substantially transparent material; and b) said marking formulation is compatible with said transparent material for marking purposes.

6. The game card of claim 1, wherein:

a) said substrate includes a third section; and b) said third section includes a second set of game data covered by a substantially opaque scratch-off material.

7. The game card of claim 1, and including:

a) means for moistening said marking formulation and using the moistened formulation to mark the selected areas of said first section.

8. The game card of claim 7, wherein:

a) said moistening means comprises a tear-off section of said substrate.

9. The game card of claim 1, and including;

a) a marking device for moistening said marking formulation and using the moistened formulation to mark the selected areas of said first section.

10. A scratch-off game card, comprising:

a) a substrate including first, second and third sections, said first section located on a first area of said substrate, said second section located on a second area of said substrate, said third section located on a third area of said substrate, said first, second and third areas being separate from one another;

b) a first section including a first set of game data covered by a substantially opaque scratch-off material;

c) a second section including a second set of game data;

d) a third section including means for marking selected areas of said second section; and e) said marking means including a marking formulation.

11. The game card of claim 10, wherein:

a) said second set of game data is covered by a substantially transparent material; and b) said marking formulation is compatible with said transparent material for marking purposes.

12. The game card of claim 10, wherein:

a) said marking formulation comprises a solvent-based coating.

13. The game card of claim 10, wherein:

a) said marking formulation is covered by a removable layer.

14. The game card of claim 10, wherein:

a) said marking formulation comprises a water-soluble material non-toxic to humans.

15. A method of producing a game card, comprising the steps of:

a) providing a substrate having first and second sections, said first section located on a first area of said substrate, and said second section located on a second area of said substrate separate from said first area;

b) providing on said first section a first set of game data; and c) providing on said second section a marking formulation for marking selected areas of said first section.

16. The method of claim 15, wherein:

a) said marking formulation comprises a solvent based coating.

17. The method of claim 16, wherein:

a) said coating comprises a water soluble material non-toxic to humans.

18. The method of claim 15, and including the step of:

a) covering said marking formulation with a removable layer.

19. The method of claim 15, and including the step of:

e) providing a tear-off section in said substrate.

20. A game card made in accordance with the method of claim 15.

21. A game card, comprising:

a) a substrate including first and second sections;

b) said first section including a first set of game data;

c) said second section including means for marking selected areas of said first section;

d) said marking means including a marking formulation; and e) means for moistening said marking formulation and using the moistened formulation to mark the selected areas of said first section.

22. A game card, comprising:

a) a substrate including first and second sections;

b) said first section including a first set of game data;

c) said second section including means for marking selected areas of said first section;

d) said marking means including a marking formulation; and e) a marking device for moistening said marking formulation and using the moistened formulation to mark the selected areas of said first section.

* * * * *